US012091862B2

(12) United States Patent
Buhrman et al.

(10) Patent No.: US 12,091,862 B2
(45) Date of Patent: Sep. 17, 2024

(54) ADHESIVE STRIP ATTACHMENT OF ROOF BOARDS TO A CORRUGATED ROOF DECK

(71) Applicant: CARLISLE CONSTRUCTION MATERIALS, LLC, Carlisle, PA (US)

(72) Inventors: Chad Buhrman, Mechanicsburg, PA (US); Cody Turnow, York, PA (US); Chase Cramer, Shippensburg, PA (US); Benjamin Tigyer, Shippensburg, PA (US); Robert Aferri, Heath, TX (US); Michael Scanish, Camp Hill, PA (US); Brandon Reynolds, New Cumberland, PA (US)

(73) Assignee: CARLISLE CONSTRUCTION MATERIALS, LLC, Carlisle, PA (US)

( * ) Notice: Subject to any disclaimer, the term of this patent is extended or adjusted under 35 U.S.C. 154(b) by 180 days.

(21) Appl. No.: 17/946,922

(22) Filed: Sep. 16, 2022

(65) Prior Publication Data

US 2023/0138907 A1 May 4, 2023

Related U.S. Application Data

(60) Provisional application No. 63/275,824, filed on Nov. 4, 2021.

(51) Int. Cl.
*E04D 5/14* (2006.01)

(52) U.S. Cl.
CPC ..... *E04D 5/148* (2013.01); *E04D 5/141* (2013.01)

(58) Field of Classification Search
CPC ..... E04D 5/148; E04D 5/141; E04D 13/174; E04D 13/176; E04D 3/352; E04D 11/02; E04D 12/002; E04D 13/1643; E04D 1/36
See application file for complete search history.

(56) References Cited

U.S. PATENT DOCUMENTS

| | | | | |
|---|---|---|---|---|
| 3,971,184 | A | 7/1976 | Van Wagoner | |
| 5,685,935 | A | 11/1997 | Heyer et al. | |
| 5,737,897 | A | 4/1998 | Naipawer, III | |
| 5,840,392 | A | 11/1998 | Clark et al. | |
| 6,093,354 | A | 6/2000 | Hubbard et al. | |
| 6,790,520 | B1 | 9/2004 | Todd et al. | |
| 7,056,556 | B2 * | 6/2006 | Burns | B05C 17/00576 118/305 |
| 8,122,664 | B2 | 2/2012 | Ben-Daat et al. | |
| 10,065,394 | B2 | 9/2018 | Tang et al. | |
| 10,112,334 | B2 | 10/2018 | Douglas et al. | |
| 10,132,082 | B2 | 11/2018 | Tang et al. | |
| 10,370,854 | B2 | 8/2019 | Tang et al. | |
| 10,519,663 | B2 | 12/2019 | Tang et al. | |
| 11,065,796 | B2 | 7/2021 | Douglas et al. | |

(Continued)

*Primary Examiner* — Vishal I Patel
(74) *Attorney, Agent, or Firm* — David R. Heckadon; Gordon Rees Scully Mansukhani LLP

(57) ABSTRACT

A system for adhering a roof board onto a corrugated roof by positioning an adhesive strip dispensing machine over a plurality of parallel top flutes of a corrugated roof and then simultaneously dispensing a plurality of adhesive strips on top of each of the plurality of parallel top flutes of the corrugated roof. The dispensing machine has a plurality of wheels or rollers mounted to a frame and a plurality of adhesive roll dispensers, and the adhesive is dispensed onto the top of top flutes by moving the dispensing machine in a direction parallel to the top flutes.

10 Claims, 12 Drawing Sheets

(56) References Cited

U.S. PATENT DOCUMENTS

| | | | |
|---|---|---|---|
| 2004/0261347 | A1 | 12/2004 | Hageman |
| 2006/0096213 | A1 | 5/2006 | Griffin et al. |
| 2006/0099370 | A1 | 5/2006 | Glass |
| 2006/0179749 | A1 | 8/2006 | Brandt et al. |
| 2011/0173910 | A1 | 7/2011 | Franklin et al. |
| 2015/0040503 | A1 | 2/2015 | Tackett et al. |
| 2016/0230392 | A1 | 8/2016 | Tang et al. |
| 2017/0015027 | A1 | 1/2017 | Letts et al. |
| 2017/0015083 | A1 | 1/2017 | Tang et al. |
| 2017/0044406 | A1 | 2/2017 | Hubbard et al. |
| 2017/0114543 | A1 | 4/2017 | Tang et al. |
| 2017/0210091 | A1 | 7/2017 | McJunkins et al. |
| 2019/0047199 | A1 | 2/2019 | Douglas et al. |
| 2019/0186124 | A1 | 6/2019 | Hubbard et al. |
| 2019/0316359 | A1 | 10/2019 | Tang et al. |
| 2020/0055275 | A1 | 2/2020 | Yao et al. |
| 2020/0216722 | A1 | 7/2020 | Wilfried et al. |
| 2020/0299967 | A1 | 9/2020 | Tang et al. |
| 2020/0324511 | A1 | 10/2020 | McJunkins et al. |
| 2021/0108408 | A1 | 4/2021 | Letts et al. |
| 2021/0198527 | A1 | 7/2021 | Hubbard et al. |

* cited by examiner

ADHESIVE STRIP ATTACHMENT OF ROOF BOARDS TO A CORRUGATED ROOF DECK

RELATED APPLICATION

The present application claims priority to U.S. Provisional Patent Application No. 63/275,824, entitled Adhesive Strip Attachment of Roof Boards to a Roof Deck, filed Nov. 4, 2021, the entire disclosure of which is incorporated herein by reference in its entirety for all purposes.

TECHNICAL FIELD

The present system relates to attaching roofing boards to corrugated roofs.

BACKGROUND OF THE INVENTION

Insulation and underlayments are typically attached to a roof deck using screws and fasteners and plates or with low-rise adhesive foam. Unfortunately, installing screws and fasteners and plates is labor intensive from both a time and an effort standpoint. Additionally, the screw that penetrates the roof deck can potentially disturb building occupants and the operations occurring within the building. Moreover, screws, fasteners and plates can serve as thermal conduits for heating/cooling loss within the building as they bypass the insulation and underlayment boards via thermal bridging.

Yet another problem is that screw penetration into the roof deck creates a potential for building generated moisture to pass into the roof, which can then become trapped and condense into liquid water causing moisture problems in the roof system. Therefore, to avoid or minimize the use of mechanical screw fasteners, adhesives have been used instead. Unfortunately, the application of low-rise adhesive is costly, is not permitted by some approval bodies, and is not well suited for low temperatures.

Accordingly, what is instead desired is a system for attaching roof boards (understood herein to include both insulation and underlayment cover boards) that both avoids the use of mechanical fasteners and also minimizes the use of adhesives. Minimizing adhesives has several benefits. First, reducing adhesives reduces the roof's overall fire risk (since the adhesives are generally the most fire-risk element of a typical roof assembly). Second, as will be further explained herein in accordance with the present system, reducing the total amount of adhesive in the roof board installation process makes the overall assembly cleaner, cheaper and faster.

SUMMARY OF THE INVENTION

In preferred aspects, the present system and method apply adhesive strips (having an integrated release liner attached thereto) to the top flutes of a corrugated metal roof deck with a multi-row, custom designed adhesive applicator/dispenser system. The present system advantageously allows for the attachment of roof boards to a roof deck without the use of fasteners and plates or low-rise foam adhesive. In preferred aspects, both initial and subsequent layers of roof boards may be applied to the corrugated roof.

In preferred aspects, the present invention allows for the attachment of the insulation and underlayment roof boards to the roof deck by means of adhesive strips that are quickly and easily applied only to the top flutes of a corrugated roof deck. In preferred aspects, a modified version of a standard cover tape applicator can optionally be utilized along with parallel rolls of adhesives to apply several runs of adhesive (for example, 2 or 3 rows at a time) to the top flutes of the corrugated roof deck. The present adhesive application dispensing machine can optionally also allow adjustment for varied width of roof deck flutes.

As will be explained herein, using adhesive strips has the advantage of avoiding commonly used screws and mechanical fasteners (which can cause both heat and moisture problems). In addition, minimizing the total amount of adhesive used has the advantage of reducing fire risk and cost. As will be shown, the present system has the advantage of using an appropriate amount of adhesive to balance these two competing objectives. Moreover, the present system's adhesive is preferably not a "low-rise" adhesive (which can be very sensitive to environmental conditions).

In preferred aspects, additional layers of cover boards (such as insulation boards) can be installed in the same manner via the adhesive roll dispenser, but with the application of the adhesive strips onto the (first or lower) cover board versus directly onto the corrugated roof deck. This optional process can be repeated such that subsequent layers of insulation/cover boards can be installed one on top of the other in the same manner.

Advantageously, the adhesive strips applied using the present system take the place of traditional methods of either screw/plate attachment or adhering boards to the deck with low-rise foam adhesive. The present adhesive strips, when applied, will preferably contain a release liner, thereby protecting the adhesive until it is ready for use. This release liner will allow the dispensing machine to work on the roof and position the insulation boards without negatively effecting the adhesive strip performance. During installation, the adhesive release liner is removed, and the insulation board can then be placed thereover and secured by simply applying pressure. Additional layers of insulation cover boards can be installed in the same manner. Roofing membranes (i.e.: the building's uppermost layers) can optionally be attached via traditional methods.

In one preferred aspect, the present adhesive dispensing system provides a system for adhering a roof board to a corrugated roof, comprising: (a) an adhesive strip dispensing machine, comprising: (i) a frame, (ii) a plurality of wheels or rollers mounted to the frame, and (iii) a plurality of adhesive roll dispensers also mounted to the frame; and (b) a plurality of adhesive rolls on the adhesive roll dispensers. The adhesive rolls are positioned to be simultaneously dispensed from the adhesive roll dispensers onto the top flutes of a corrugated roof as the adhesive strip dispensing machine is moved in a direction parallel to the top flutes.

In one aspect, the wheels rest on the bottom flutes of the corrugated roof as the adhesive strips are dispensed on the top flutes of the corrugated roof. As such, the plurality of wheels are preferably spaced apart such that the dispensing machine is positioned over the tops of a plurality of top flutes (e.g.: 2 or 3 rows of top flutes) of the corrugated roof. In other aspects, the wheels rest on top of the top flutes as the adhesive strips are dispensed on the top flutes of the corrugated roof. Optionally, the wheels on the present system may be replaced by rollers. It is to be understood that the present system encompasses all of these embodiments. The present adhesive strip dispensing machine preferably has handlebars that are manually pushed (or optionally pulled) by an operator. In some embodiments, the operator also rotates the frame with the handlebars such that the plurality of adhesive rolls are rotated to be positioned downwardly into contact with the top flutes of the corrugated roof. The positioning of the adhesive roll dispensers themselves on the frame of the dispenser may also preferably be adjustable to correspond to different top flute widths.

In other aspects, the present system comprises a method of adhering a roof board to a corrugated roof, comprising: positioning an adhesive strip dispensing machine over a plurality of parallel top flutes of a corrugated roof and then simultaneously dispensing a plurality of adhesive strips on top of each of the plurality of parallel top flutes of the corrugated roof. In operation, the wheels of the dispenser are placed on the top or the bottom flutes of the corrugated roof, and then the adhesive roll dispensers are positioned such that adhesive rolls will contact the top flutes of the corrugated roof when the wheels or rollers of the device are positioned on the top or bottom flutes of the corrugated roof.

In various aspects, the roof board may be an insulation board or an underlayment. Using the same above-described approach, a second roof board can be attached on top of the adhesive strips applied on top of the first roof board. As such, stacking various roof boards one on top of the other with the present adhesive strips is possible. Moreover, it is to be understood that different types of roof boards may be installed one over top of the other in accordance with the present system.

DETAILED DESCRIPTION OF THE DRAWINGS

Figure 1A:
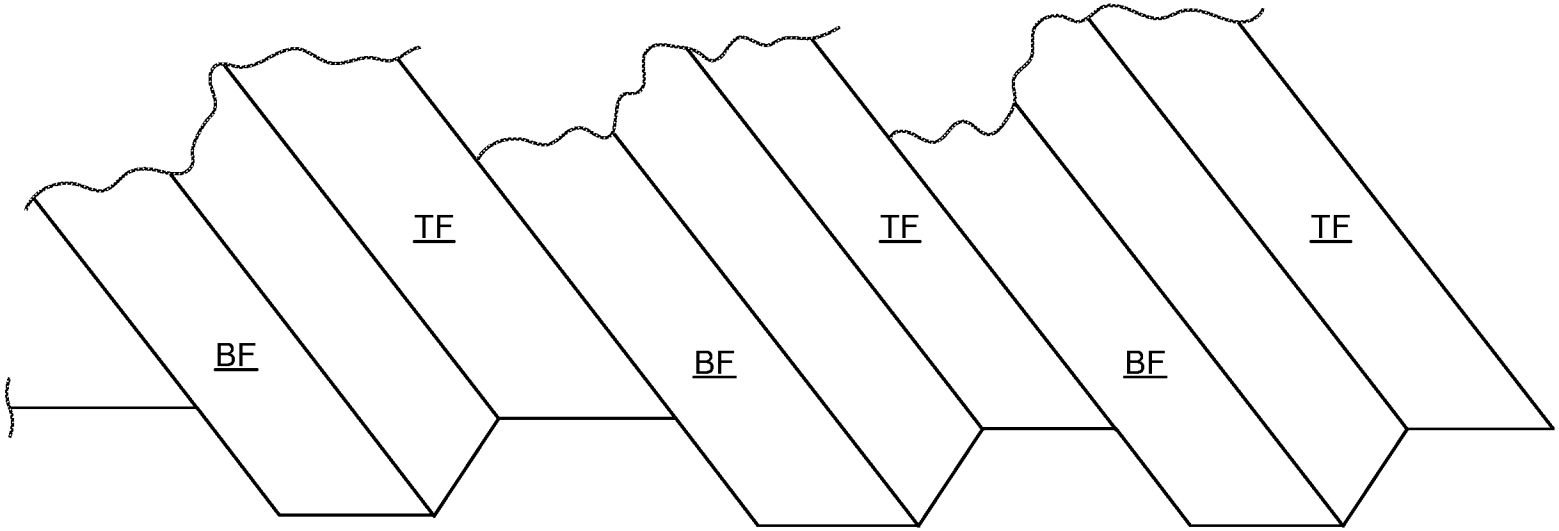
FIG. 1A is a sectional perspective view of a corrugated roof prior to the application of the adhesive strips.
Figure 1B:
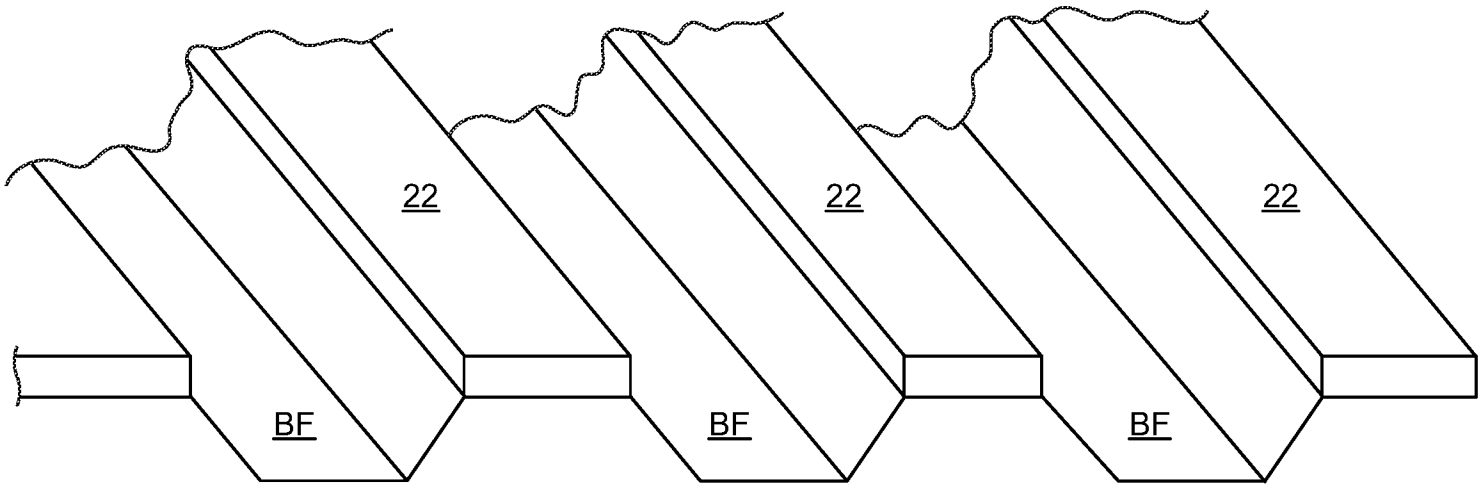
FIG. 1B is a sectional perspective view of the corrugated roof after the attachment of the adhesive strips.
Figure 1C:
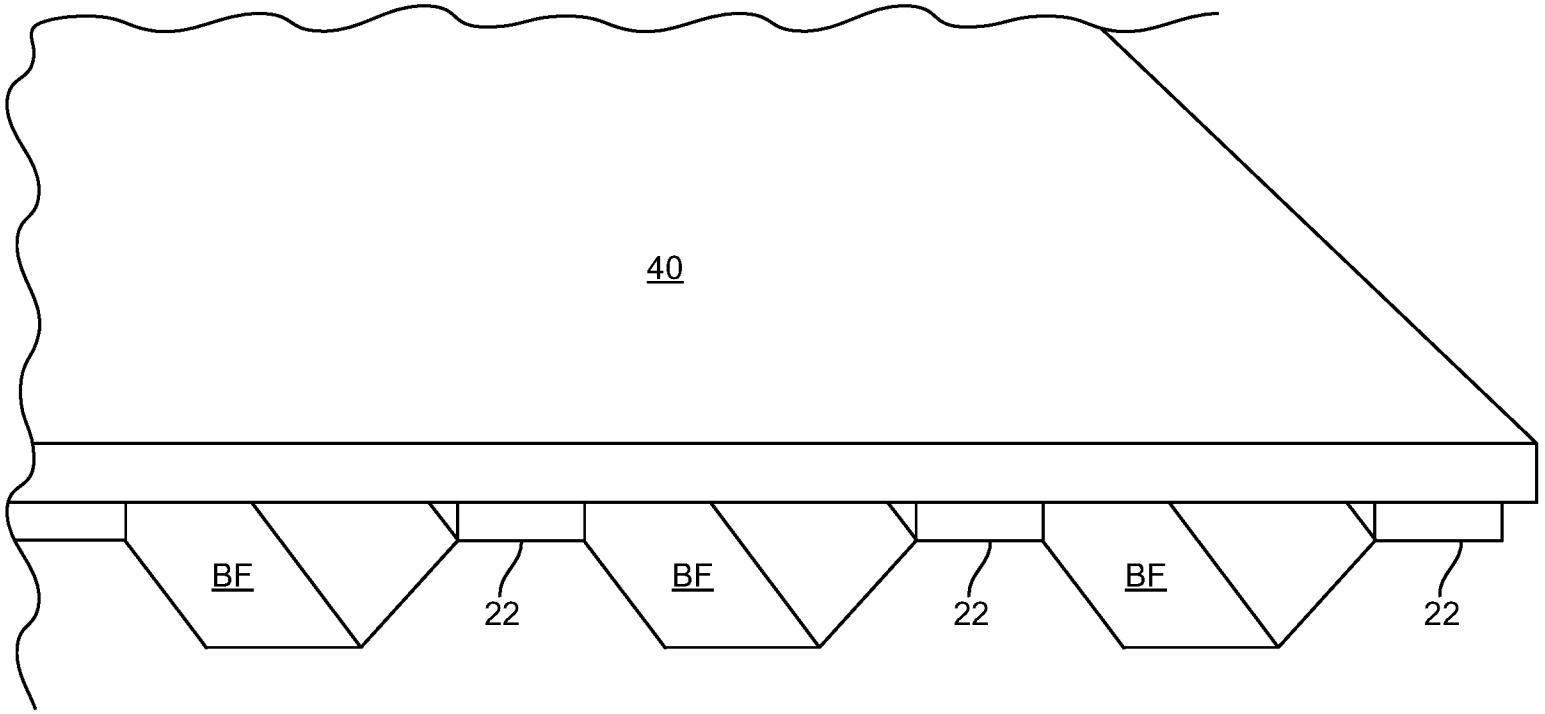
FIG. 1C is a sectional perspective view of the corrugated roof after the attachment of a roof board to the adhesive strips.
Figure 1D:
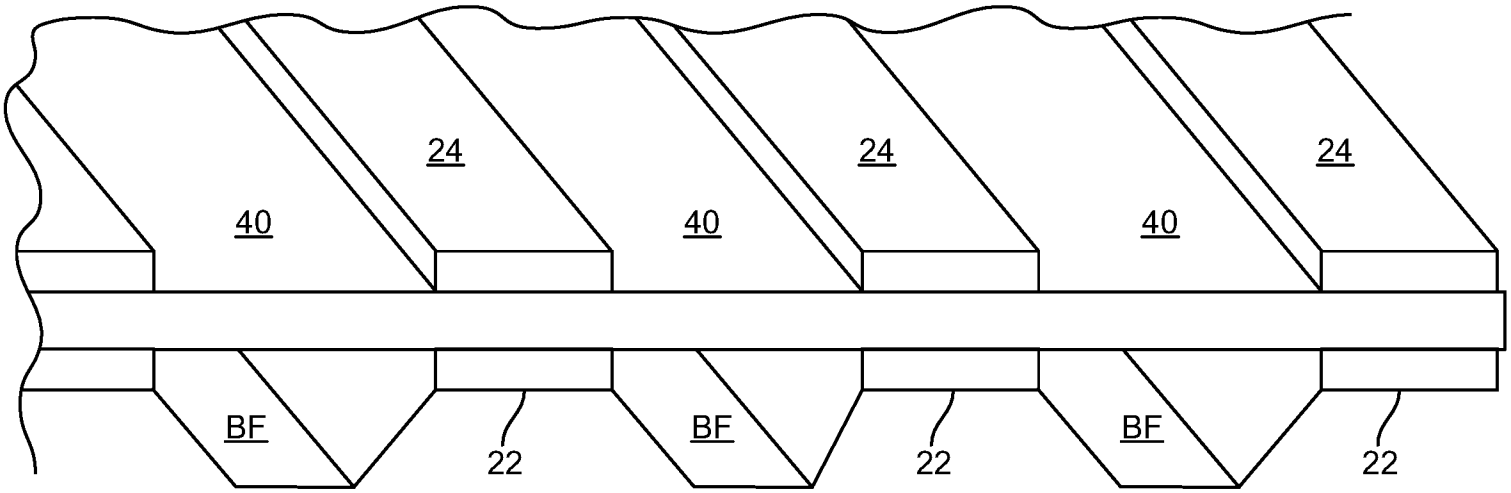
FIG. 1D is a sectional perspective view after the application of adhesive strips on top of the roof board.
Figure 1E:
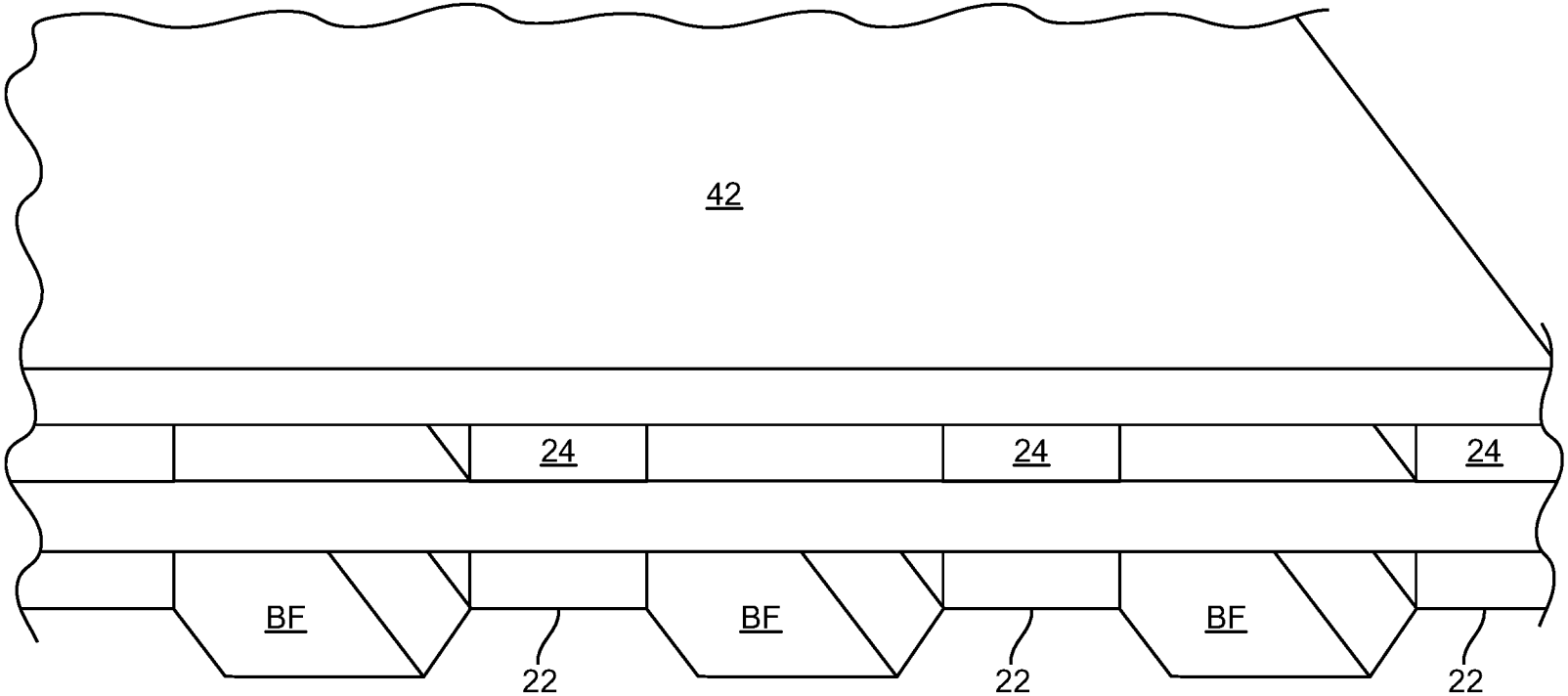
FIG. 1E is a sectional perspective view after the application of a second roof board on top of the adhesive strips on top of the first roof board.

As seen in FIG. 1A, a corrugated roof having top flutes TF and bottom flutes BF is provided. FIGS. 1A to 1C illustrate sequential steps in the attachment of a first roof board to the top flutes of a corrugated roof. FIGS. 1D and 1E illustration optional steps in the attachment of a second roof board on top of the first roof board.

Figure 2:
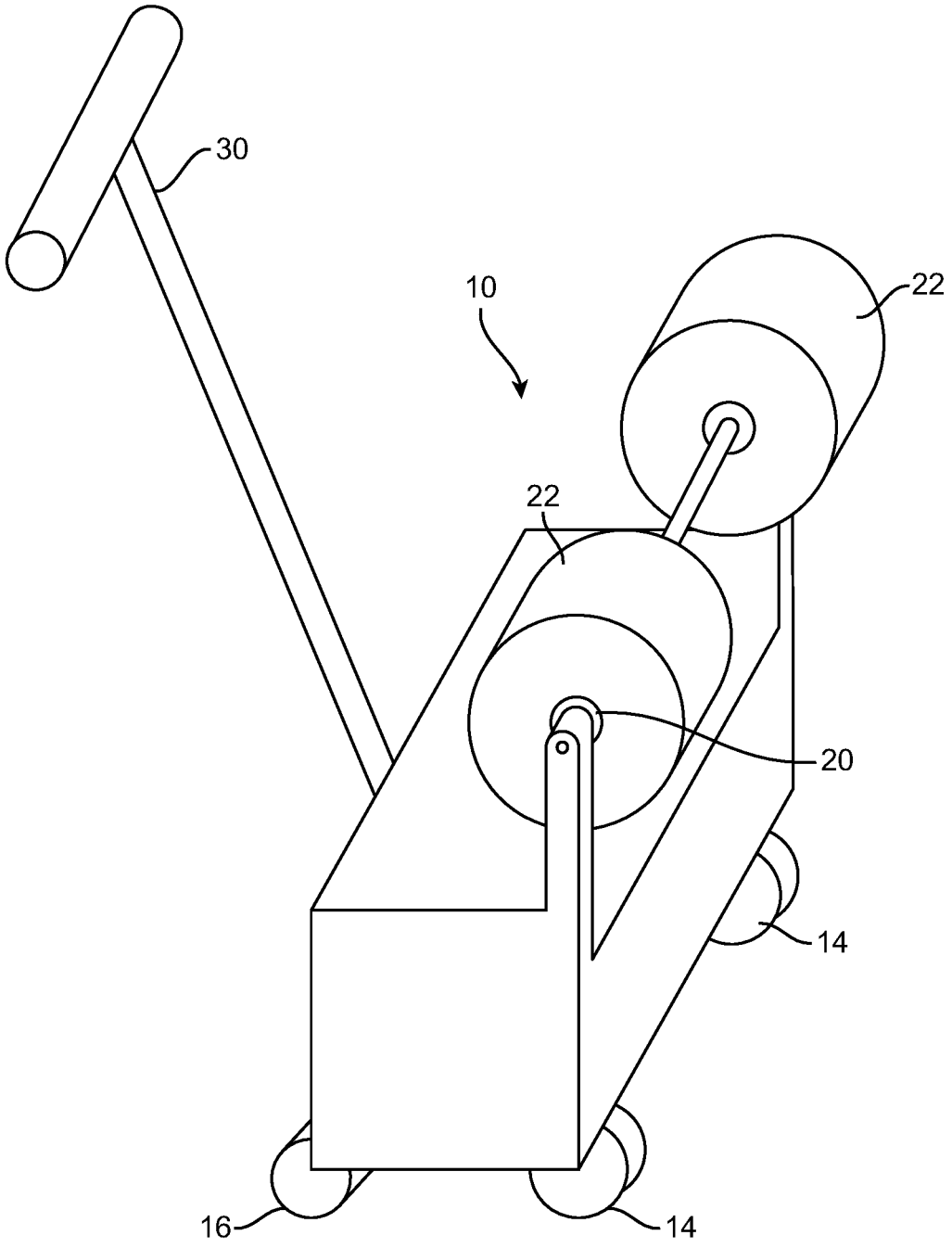
FIG. 2 is a perspective view of a preferred adhesive strip dispensing machine.

FIG. 2 is a perspective view of an adhesive strip dispensing machine 10 for use in accordance with the present system and method. Dispenser 10 as illustrated in FIG. 2 dispenses two rows of adhesive. It is to be understood that the present system includes a dispensing machine 10 that is configured to dispense any numbers of rows of adhesive, positioned side by side (so as to align with the widths and positions of top flutes TF of the corrugated roof).

Figure 3A:
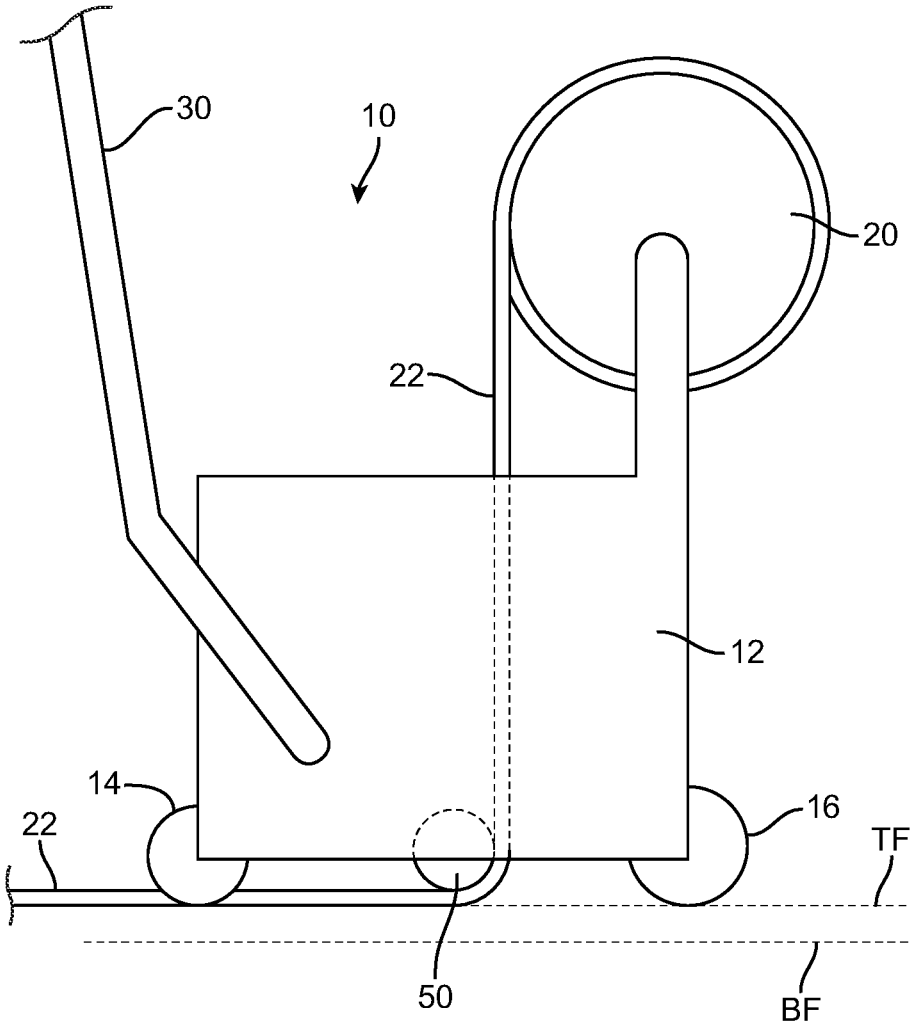
FIG. 3A is a side elevation view of an embodiment of the adhesive strip dispensing machine in which the dispending machine is not rotated forward, the adhesive is dispensed over a bottom roller on the device, and the wheels are positioned on the top flutes.
Figure 3B:
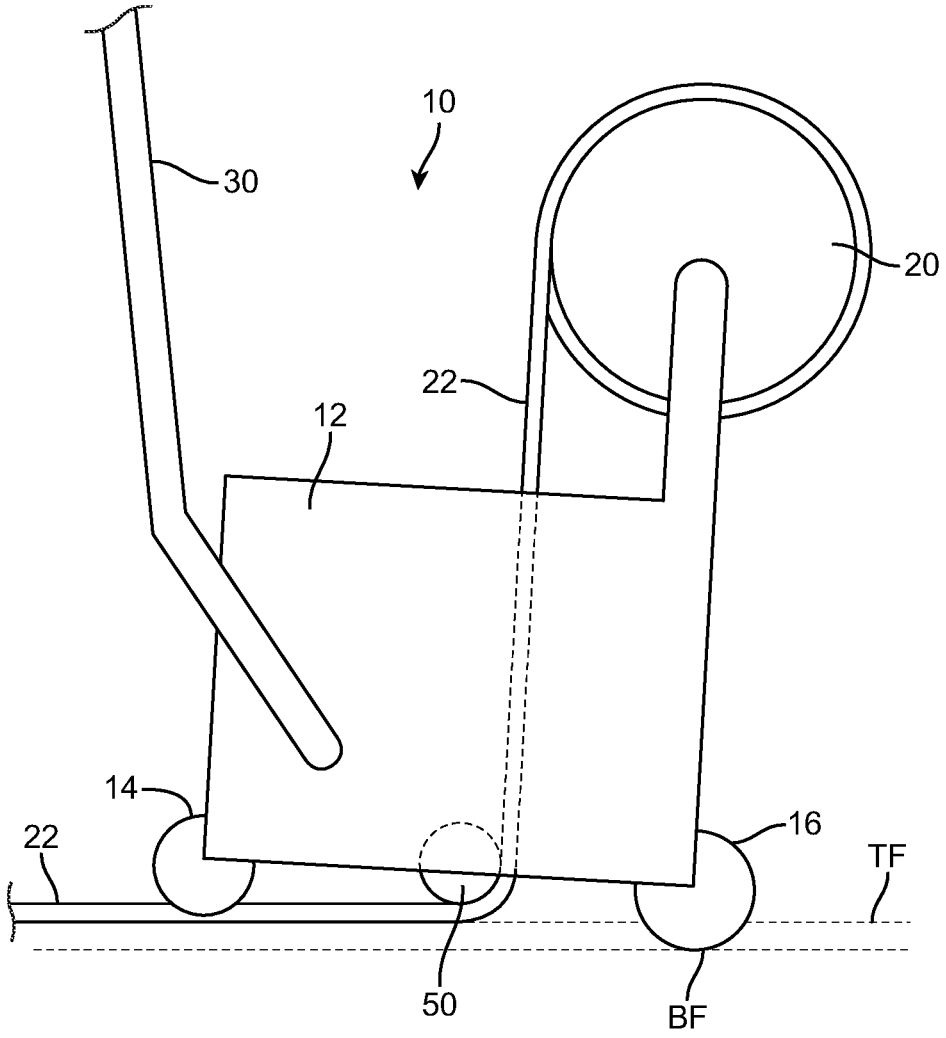
FIG. 3B is similar to FIG. 3A, but the front wheels instead are positioned on the bottom flutes.

FIGS. 3A and 3B illustrate preferred embodiments of the present adhesive strip dispensing machine 10 in which adhesive 22 is unwrapped and dispensed over a bottom roller 50 on the device. As seen in FIGS. 3A and 3B, the adhesive strip dispensing machine 10 preferably comprises: (i) a frame 12, (ii) a plurality of wheels or rollers 14 and 16 mounted to frame 12, and (iii) a plurality of adhesive roll dispensers 20 mounted to frame 12; and (iv) a plurality of adhesive rolls 22 also mounted to frame 12.

In FIG. 3A, the adhesive 22 simply passes between front wheels 14 as the adhesive is laid down over the top flutes TF. (Alternatively, wheel 14 or another roller could pass over the top of the laid-down adhesive 22 to help set it in place). FIG. 3B is similar to FIG. 3A, but in this application, rear wheels 16 are instead positioned on top of the bottom flutes BF. In the embodiment of FIGS. 3A and 3B, the dispending machine 10 is not rotated with respect to the roof as the adhesive strips are laid down onto the top flutes TFs. It is to be understood that the present system encompasses all of these different embodiments and approaches including versions with either or both of wheels 14 and 16 positioned on the top flutes TF or the bottom flutes BF as adhesive 22 is applied to the top flutes.

Figure 4A:
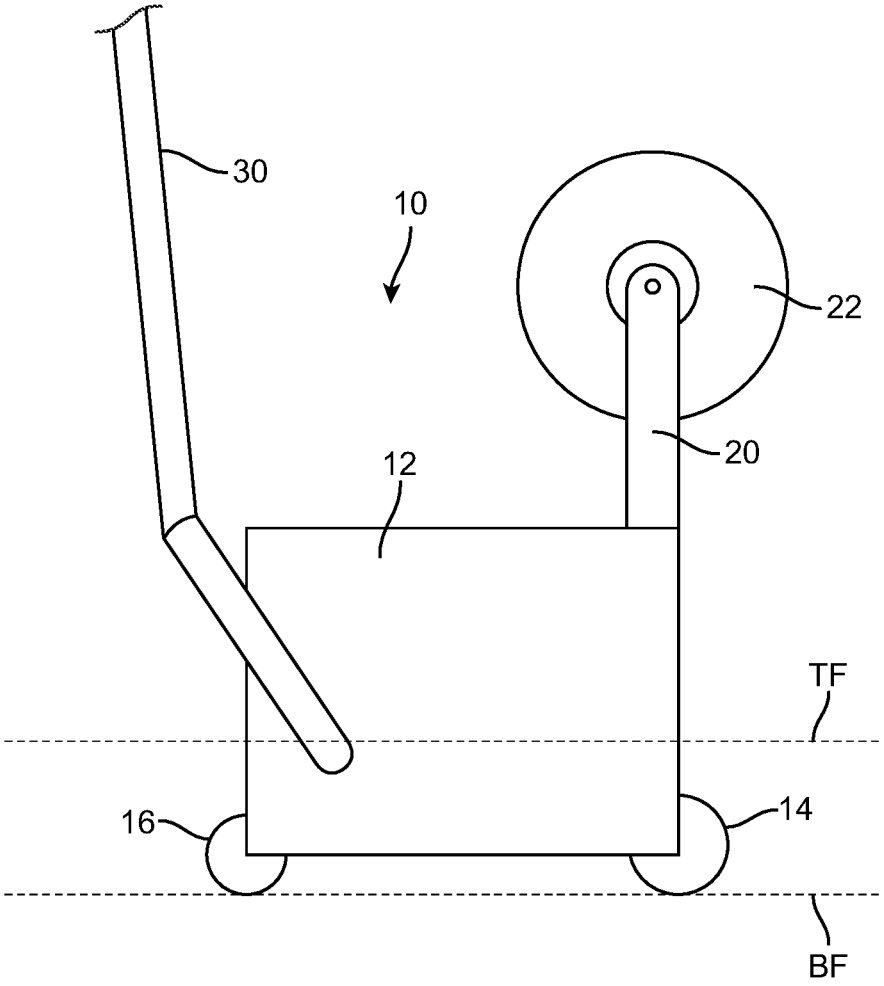
FIG. 4A is a side elevation view of an embodiment of a rotating adhesive strip dispensing machine prior to use, with the front and rear wheels of the machine sitting on the bottom flutes of the corrugated roof.
Figure 4B:
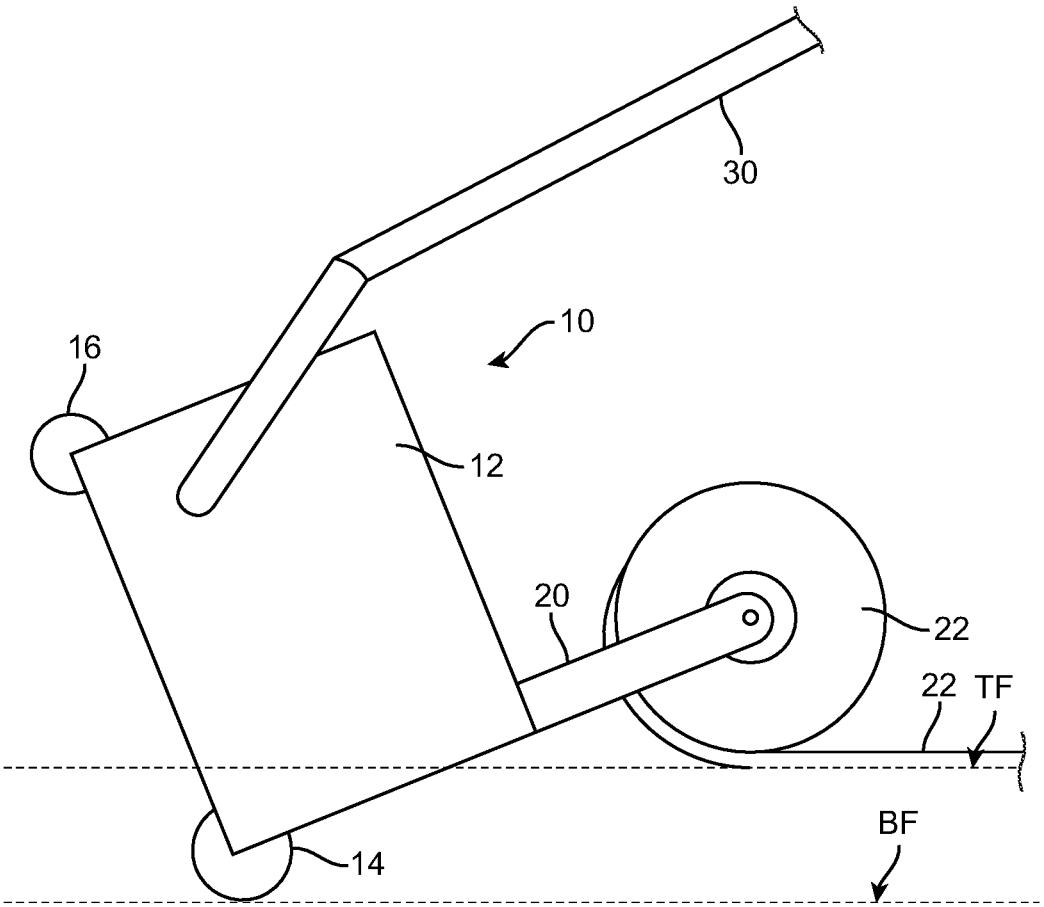
FIG. 4B is a side elevation view of the rotating adhesive strip dispensing machine of FIG. 4A as the adhesive strips are being applied to the top flutes of the corrugated roof, with the front wheels of the machine on the bottom flutes of the corrugated roof.

FIGS. 4A and 4B illustrate another embodiment of adhesive dispensing machine 10 with FIG. 4A illustrating the adhesive strip dispensing machine prior to use and FIG. 4B illustrating the adhesive strip dispensing machine in use. By rotating the dispenser from the position of FIG. 4A to that of FIG. 4B, adhesive rolls 22 are positioned to be simultaneously dispensed from the adhesive roll dispensers 20 onto top flutes TF of a corrugated roof as the adhesive strip dispensing machine 10 is moved in a direction parallel to the top flutes.

Figure 5A:
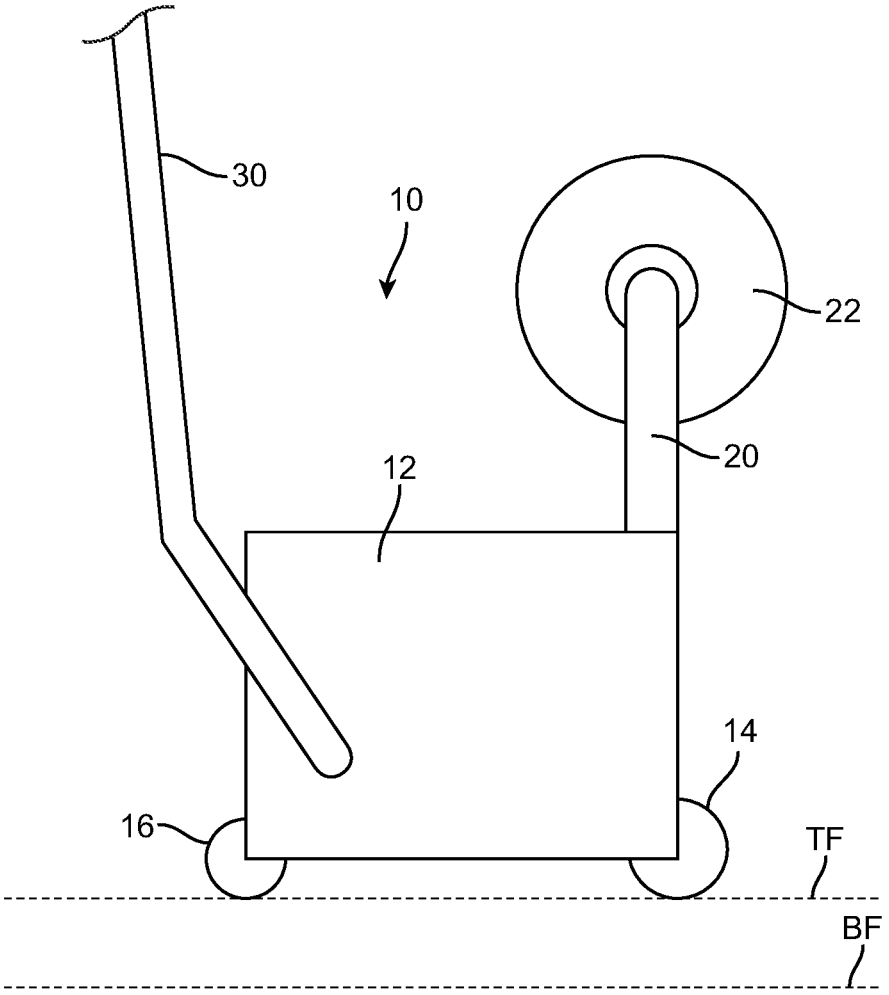
FIG. 5A is a side elevation view of another embodiment of the rotating adhesive strip dispensing machine prior to use, with the front and rear wheels of the machine sitting on the bottom flutes of the corrugated roof.
Figure 5B:
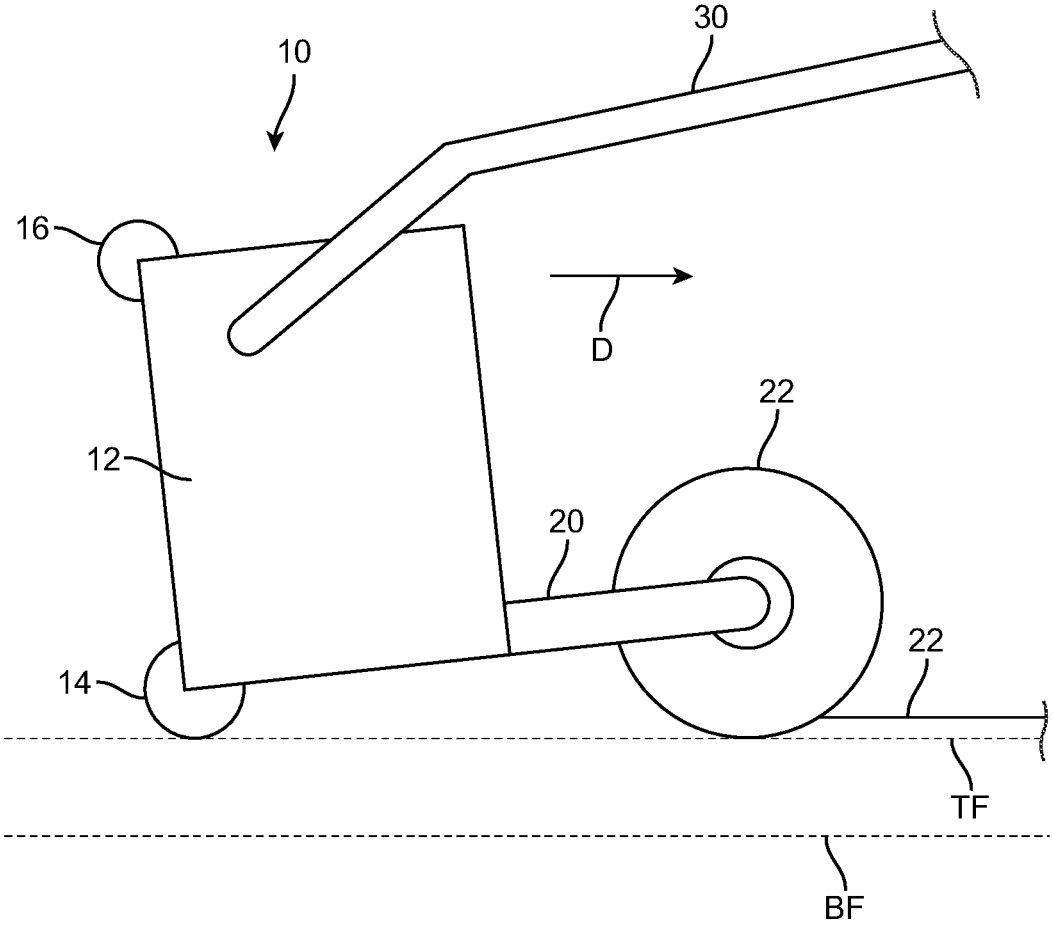
FIG. 5B is a side elevation view of the rotating adhesive strip dispensing machine of FIG. 5A as the adhesive strips are being applied to the top flutes of the corrugated roof.

FIGS. 5A and 5B illustrate another method of using the dispenser 10 of FIGS. 4A and 4B. In FIGS. 5A and 5B, however, both the front wheels 14 and the rear wheels 16 are placed on top of top flutes TFs and front wheels 14 remain on top of top flutes TF as the dispenser 10 is moved and the adhesive strips are dispensed.

It is to be understood that any of the adhesive dispensers 10 or methods of using adhesive dispensers illustrated in FIGS. 2 to 5B can be used to apply either one or more layers of roof boards onto the roof (as illustrated in sequential FIGS. 1A to 1E). Moreover, when successive roof boards are applied one over another, it is to be understood that the roof boards may be made of the same material or of different materials.

FIG. 1A shows sectional perspective view of a corrugated roof prior to the application of the adhesive strips. Specifically, the corrugated roof has alternating top flutes TFs and bottom flutes BF as is common in the industry. Next, as seen in FIG. 1B, strips of adhesive 22 are applied to the top flutes TFs using any of the systems and methods disclosed herein. For example, this may be done by placing front wheels 14 onto bottom flutes BF (as in FIGS. 4A and 4B) and then moving the dispenser 10 while front wheels 14 are moved along bottom flutes BFs. This may also be done by placing front wheels 14 onto top flutes TF (as in FIGS. 5A and 5B) and then moving the dispenser 10 while front wheels 14 are moved along top flutes TFs.

For example, as seen in FIG. 4A, front wheels 14 and rear wheels 16 are preferably placed onto bottom flutes BF. Next, as seen in FIG. 4B, dispenser 10 can be rotated such that adhesive rolls 22 are then positioned on top of top flutes TF. Simply put, the operator grabs handlebars 30 and rotates frame 10 forward as shown (moving from the position of FIG. 4A to 4B). The operator then simply pulls dispensing machine 10 (with front wheels 14 remaining on bottom flutes BF) along the roof such that the adhesive rolls 22 are deposited on top of top flutes TF.

In preferred aspects, the adhesive rolls 22 have a width corresponding to the width of a top flute TF of the corrugated roof. As can also be seen, wheels 14 are preferably spaced apart such that the dispensing machine 10 is positioned over a plurality of top flutes of the corrugated roof. In preferred aspects, the width of the body of dispensing machine 10 may span over two or three rows of top flutes TFs. It is to be understood, however, that the present system encompasses dispensing machines 10 that simultaneously cover any number of parallel rows of top flutes TFs, including only one row of top flutes. Preferably, dispensing machine 10 may be built to specifically accommodate a specific width of top flutes (such that wheels 16 rest on the bottom flutes BFs for that particular roof dimension). Optionally, however, dispensing machine 10 may be built such that the spacing between wheels 14 is itself adjustable such that wheel 14 can be spaced a correct distance apart such that that rest on top of the bottom flutes BFs of that particular roofing layout. Moreover, the rolls of adhesive 22 may be selected to have a width corresponding to the width of the particular top flutes of the roof. IE: wider rolls of adhesive may be used on wider top flutes and narrower rolls of adhesive be used on narrower top flutes.

Next, as seen in FIG. 1C, the operator removes a release layer on top of adhesive strips 22, and then put a cover board 40 on top of the adhesive strips 22, thereby securing the cover board 40 into position. One primary advantage of the present approach is that adhesives are only applied at the top flutes TFs. This is fundamentally different with existing approaches of simply applying adhesives across the full roof surface, since such existing approaches simply fill the entire area between bottom flutes BFs and the bottom of cover board 40. The disadvantages of such an approach are easy to see. First, it wastes a huge amount of adhesive and makes the entire installation quite messy. Second, by wasting adhesives, it increases overall costs. Third, adhesives are typically the most flammable part of a roof assembly. Therefore, minimizing adhesive use makes the entire roofing assembly less flammable, and therefore safer.

Optionally thereafter, additional cover boards (e.g.: insulation boards, underlayments, etc.) can be installed on top of the first roof board 40. Specifically, as seen in FIG. 1D, a second layer of adhesive strips 24 can be applied on top of second roof board 40. It is to be understood that the second layer of adhesive strips 24 can be laid down in the same orientation as the first layer of adhesive strips 22. This however is not required. For example, the second layer of adhesive strips 24 can be laid out in rows that are perpendicular (or otherwise angled to) the first layer of adhesive strips 22. This is because the wheels 14 would simply traverse across the top of first cover board 40, and are not constrained by having to move along in the direction of the bottom flats BFs. Thereafter, a second cover board 42 can be secured into place on top of adhesive strips 24/first cover board 40. It is to be understood that the present method may be repeated to add additional cover boards one on top of another. It is also to be understood that cover boards 40 and 42 may be made of the same materials or different materials. Moreover, the term "cover board" as used herein refers to insulation boards, underlayments, and any other form of roofing board without limitation.

Also in preferred aspects, the present system includes a method of adhering a roof board to a corrugated roof, comprising: positioning an adhesive strip dispensing machine over a plurality of parallel top flutes of a corrugated roof and then simultaneously dispensing a plurality of adhesive strips on top of each of the plurality of parallel top flutes of the corrugated roof. In this preferred method, the adhesive strip dispensing machine 10 preferably comprises: a frame 12, a plurality of wheels 14 and 16 mounted to the frame, and a plurality of adhesive roll dispensers 20 mounted to frame 10. The preferred method optionally also comprises placing wheels 16 on top of bottom flutes BFs of the corrugated roof, and then lowering the adhesive roll dispensers 20 such that adhesive rolls 22 contact the top flutes TF of the corrugated roof when wheels 14 are positioned on the bottom flutes BF of the corrugated roof.

Optionally, the method may also include adjusting the spacing between wheels 14 such that the wheels are positioned on top of bottom flutes of corrugated rooves of different dimensions. The operator lowers the adhesive roll dispensers 20 by rotating frame 12 with handlebars 30. Next, the operator pulls handlebars 30, thereby moving the adhesive strip dispensing machine 10 across the corrugated roof as it lays out the parallel strips of adhesive 22 on the top flutes TFs of the roof. Next, the operator removes a release layer from each of the adhesive strips 22; and then places a cover or roof board on top of adhesive strips 22, thereby securing roof board 40 to the corrugated roof. The method can be repeated to lay additional roof or cover boards on top of the first cover board, as desired.

FIG. 5A illustrates a second embodiment of the adhesive strip dispensing machine prior to use and FIG. 5B illustrates the adhesive strip dispensing machine in use. In this embodiment, 14 is a roller that may optionally span across the front of the device. (Alternatively, element 14 may be a plurality of rollers or a plurality of wheels, all keeping within the scope of the present invention). In this preferred embodiment, wheels/rollers 14 and 16 are positioned on top of the top flutes TF prior to the adhesive dispensing (FIG. 5A). The device is then rotated by the user such that adhesive roll 22 is in contact with the top flutes (FIG. 5B). When a user moves the device in direction D, the rollers/wheels 14 will then roll over the newly-applied adhesive and help the adhesive to "set". Since the depth of the flutes can vary from one roof to the next (based on deck type), this second preferred embodiment of the present system has the advantage that it does now have to compensate for the depth changes in the flutes (as it only utilizes the top flutes).

What is claimed is:

1. A system for adhering a roof board to a corrugated roof, comprising:

(a) an adhesive strip dispensing machine, comprising:

(i) a frame, (ii) a plurality of wheels or rollers mounted to the frame, and (iii) a plurality of adhesive roll dispensers mounted to the frame; and (b) a plurality of adhesive rolls, wherein the adhesive rolls are positioned to be simultaneously dispensed from the adhesive roll dispensers onto top flutes of a corrugated roof as the adhesive strip dispensing machine is moved in a direction parallel to the top flutes.

2. The system of claim 1, wherein the wheels are positioned on bottom flutes of the corrugated roof as the adhesive strips are dispensed on the top flutes of the corrugated roof.

3. The system of claim 1, wherein the adhesive rolls have a width corresponding to the width of a top flute of the corrugated roof.

4. The system of claim 1, wherein the plurality of wheels are spaced apart such that the dispensing machine is positioned over a plurality of top flutes of the corrugated roof.

5. The system of claim 1, wherein the adhesive strip dispensing machine has handlebars that are manually pulled or pushed by an operator.

6. The system of claim 5, wherein the operator rotates the frame by moving the handlebars such that the plurality of adhesive rolls are positioned into contact with the top flutes of the corrugated roof.

7. The system of claim 1, wherein each of the adhesive rolls each have a release layer thereon.

8. The system of claim 1, wherein the plurality of adhesive roll dispensers is two or three adhesive roll dispensers.

9. The system of claim 1, wherein a separation distance between the wheels is adjustable to correspond to different top flute widths.

10. The system of claim 1, wherein the positioning of the adhesive roll dispensers is adjustable to correspond to different top flute widths.

* * * * *